US009636533B2

(12) United States Patent
Tian et al.

(10) Patent No.: US 9,636,533 B2
(45) Date of Patent: May 2, 2017

(54) METAL-CARBONYL-CONTAINING FIRE EXTINGUISHING COMPOSITION

(75) Inventors: Wei Tian, Xi'an (CN); Tengfei Zhai, Xi'an (CN); Tao Ji, Xi'an (CN)

(73) Assignee: XI'AN WESTPACE FIRE TECHNOLOGY CO., LTD, Xi'An, Shaanxi (CN)

( * ) Notice: Subject to any disclaimer, the term of this patent is extended or adjusted under 35 U.S.C. 154(b) by 0 days.

(21) Appl. No.: 14/367,418

(22) PCT Filed: Aug. 16, 2012

(86) PCT No.: PCT/CN2012/080268
§ 371 (c)(1),
(2), (4) Date: Jun. 20, 2014

(87) PCT Pub. No.: WO2013/091387
PCT Pub. Date: Jun. 27, 2013

(65) Prior Publication Data

US 2014/0332709 A1 Nov. 13, 2014

(30) Foreign Application Priority Data

Dec. 20, 2011 (CN) ..... 2011 1 0451475

(51) Int. Cl.
*A62D 1/06* (2006.01)
*C06B 23/04* (2006.01)
*A62D 1/00* (2006.01)

(52) U.S. Cl.
CPC ..... *A62D 1/06* (2013.01); *A62D 1/0007* (2013.01); *C06B 23/04* (2013.01)

(58) Field of Classification Search
CPC ..... A62D 1/06; A62D 1/0007; C06B 23/04
See application file for complete search history.

(56) References Cited

U.S. PATENT DOCUMENTS

| | | | | |
|---|---|---|---|---|
| 6,089,326 | A | 7/2000 | Drakin | |
| 6,217,788 | B1 * | 4/2001 | Wucherer | A62C 5/006 149/17 |
| 8,778,213 | B2 * | 7/2014 | Guo et al. | 252/5 |
| 2001/0048094 | A1 * | 12/2001 | Hagen et al. | 252/3 |
| 2011/0155943 | A1 | 6/2011 | Posson et al. | |

FOREIGN PATENT DOCUMENTS

| | | | |
|---|---|---|---|
| CN | 102179023 | A | 9/2011 |
| CN | 102179024 | A | 9/2011 |
| CN | 102179025 | A | 9/2011 |
| CN | 102179026 | A | 9/2011 |
| CN | 102179027 | A | 9/2011 |

OTHER PUBLICATIONS

International Search Report issued Nov. 29, 2012 re: PCT/CN2012/080268: citing: CN 102179023 A, CN 102179024 A, CN 102179025 A, CN 102179026 A and CN 102179027 A.

* cited by examiner

*Primary Examiner* — Peter F Godenschwager
*Assistant Examiner* — Andrew J Oyer
(74) *Attorney, Agent, or Firm* — Novick, Kim & Lee, PLLC; Allen Xue

(57) ABSTRACT

A metal-carbonyl-containing fire extinguishing composition comprises metal carbonyl complexes. The fire extinguishing composition uses a pyrotechnic agent as a heat source and a power source. A high temperature in combustion of the pyrotechnic agent enables the fire extinguishing composition to decompose or react under heat; produced fire extinguishing substances are sprayed out together with the pyrotechnic agent, thereby achieving a fire extinguishing objective. In the fire extinguishing composition, by selecting preferable components and optimizing contents of the components, an optimum formula of the fire extinguishing composition is determined, thereby greatly improving the efficacy of the fire extinguishing composition. In addition, efficacies of the components in the fire extinguishing composition are fully utilized, which improves an effective utilization rate of the fire extinguishing composition.

15 Claims, No Drawings

METAL-CARBONYL-CONTAINING FIRE EXTINGUISHING COMPOSITION

TECHNICAL FIELD

The application belongs to the technical field of aerosol fire extinguishment, and in particular relating to an aerosol fire extinguishing composition.

BACKGROUND

Aerosol fire extinguishing technology has attracted tremendous attention because of its characteristics including non-toxicity, non-corrosiveness, high volumetric efficiency, long storage period, total flooding, and comprehensive fire extinguishment etc. In more than a decade from the end of last century to the present, aerosol technology has developed rapidly and related patents emerge in endlessly.

Existing aerosol fire extinguishing agents mainly include S type and K type extinguishing agents which mainly have the following disadvantages according to comprehensive analysis of performance characteristics: all aerosol fire extinguishing agents realize fire extinguishment combining a chemical process and a physical process by releasing a large amount of gases and active particles through oxidation-reduction reactions of the fire extinguishing agents to implement chain scission reaction of the active particles and smothering caused by envelopment of a large amount of gases. However, the aerosol fire extinguishing agent may release a large amount of heat while releasing the aerosol during combustion reaction. In order to effectively decreasing the temperature of the equipment and the aerosol to avoid a secondary fire, a cooling system needs to be added. The added cooling system results in a complex and heavy equipment structure, a complicated process and high cost. Because of the cooling system, a large amount of active particles are mainly no activity after being filtered by a cooling layer to greatly reduce the fire extinguishing performance. In addition, the existing fire extinguishing agents also fail to fully utilize the fire extinguishing efficacies of the fire extinguishing components, thus having limited fire extinguishing efficacies and causing waste of agent costs to a certain degree.

SUMMARY OF THE INVENTION

Based on the problems of low fire extinguishing efficacy and low effective utilization in fire extinguishing agents of the prior art, the application provides a fire extinguishing composition with high fire extinguishing efficacy, good safety performance and high utilization.

The application using the following technical solution: a metal-carbonyl-containing fire extinguishing composition comprises metal carbonyl complexes; the fire extinguishing composition uses a pyrotechnic agent as a heat source and a power source; a high temperature in combustion of the pyrotechnic agent enables the fire extinguishing composition to decompose or react under heat; produced fire extinguishing substances are sprayed out together with the pyrotechnic agent, thereby achieving a fire extinguishing objective.

Further, the metal carbonyl complexes is one or more of nickel tetracarbonyl $Ni(CO)_4$, iron pentacarbonyl $Fe(CO)_5$, ruthenium pentacarbonyl $Ru(CO)_5$, pentacarbonyl osmium $Os(CO)_5$, triruthenium dodecacarbonyl $Ru_3(CO)_{12}$, dodecacarbonyltriosmium $Os_3(CO)_{12}$, vanadium hexacarbonyl $V(CO)_6$, chromium hexacarbonyl $Cr(CO)_6$, molybdenum hexacarbonyl $Mo(CO)_6$, tungsten hexacarbonyl $W(CO)_6$, titanium hexacarbonyl $Ti(CO)_6$, manganese hexacarbonyl $Mn(CO)_6$, iron hexacarbonyl $Fe(CO)_6$, dimanganese decacarbonyl $Mn_2(CO)_{10}$, ditechnetium decacarbonyl $Tc_2(CO)_{10}$, dirhenium decacarbonyl $Re_2(CO)_{10}$, dicobalt octacarbonyl $CO_2(CO)_8$, diiron nonacarbonyl $Fe_2(CO)_9$ or triiron dodecarbonyl $Fe_3(CO)_{12}$.

Further, the metal carbonyl complexes is one or more of nickel tetracarbonyl $Ni(CO)_4$, chromium hexacarbonyl $Cr(CO)_6$, molybdenum hexacarbonyl $Mo(CO)_6$, tungsten hexacarbonyl $W(CO)_6$, manganese hexacarbonyl $Mn(CO)_6$, iron hexacarbonyl $Fe(CO)_6$, dimanganese decacarbonyl $Mn_2(CO)_{10}$, dicobalt octacarbonyl $Co_2(CO)_8$, diiron nonacarbonyl $Fe_2(CO)_9$ or triiron dodecarbonyl $Fe_3(CO)_{12}$.

Further, the mass percentages of the metal carbonyl complexes in the fire extinguishing composition are 5 to 90 mass %.

The fire extinguishing composition of the application further includes an auxiliary fire extinguishing agent in mass percentage larger than 10 to 95 mass %.

Further, the auxiliary fire extinguishing agent is one or more of phosphate, carbonate, basic carbonate, metal halide, metal oxide, melamine, ammonium sulfate, dicyandiamide, guanidine carbonate, nitroguanidine, or guanidine phosphate.

Further, the phosphate is one or more of calcium dihydrogen phosphate, sodium dihydrogen phosphate, sodium dihydrogenphosphate dihydrate, potassium dihydrogen phosphate, aluminum dihydrogen phosphate, ammonium dihydrogen phosphate, zinc dihydrogen phosphate, manganous dihydrogen phosphate, magnesium dihydrogen phosphate, disodium hydrogen phosphate, diammonium hydrogen phosphate, calcium hydrogen phosphate, magnesium hydrogen phosphate, ammonium phosphate, or magnesium ammonium phosphate.

Further, the carbonate is one or more of cobaltous carbonate, zinc carbonate, manganous carbonate, ferrous carbonate, strontium carbonate, sodium potassium carbonate hexahydrate, calcium carbonate, lithium carbonate, or nickel carbonate.

Further, the basic carbonate is one or more of basic cupric carbonate, basic magnesium carbonate, basic cobaltous carbonate, basic zinc carbonate, basic nickel carbonate, or basic calcium carbonate.

Further, the metal halide is one or more of potassium fluoride, potassium chloride, potassium bromide, potassium iodide, ammonium fluoride, ammonium chloride, ammonium bromide, sodium fluoride, sodium chloride, sodium bromide, sodium iodide, cobaltous chloride, ferric chloride, or ferrous chloride.

Further, the metal oxide is one or more of zinc oxide, coppicoxide, aluminium oxide, ferric oxide, ferriferrous oxide, ferrous oxide, antimony trioxide.

The fire extinguishing composition of the application further includes an adhesive in mass percentage larger than 0 and smaller than or equal to 15 mass %; the adhesive is one or more of water glass, shellac, starch, dextrin, rubber, epoxy resin, acetal adhesive, hydroxypropyl methyl cellulose or phenolic resin.

Further, components and mass percentages in the fire extinguishing composition of the application are as follows:

30 mass % to 85 mass % of metal carbonyl complexes 10 mass % to 55 mass % of auxiliary fire extinguishing component 1 mass % to 15 mass % of adhesive Further, the fire extinguishing composition further includes an additive in a mass percentage of 1 to 20 mass %; the additive is stearate, talc, graphite or a mixture thereof.

Further, components and mass percentages in the fire extinguishing composition of the application are as follows:

35 mass % to 65 mass % of metal carbonyl complexes 35 mass % to 55 mass % of auxiliary fire extinguishing component 1 mass % to 5 mass % of adhesive 1 mass % to 5 mass % of additive The flame inhibition mechanism of the fire extinguishing composition of the application is as follows:

the metal carbonyl complexes in the fire extinguishing composition can decompose to release metal ions at high temperature; the metal ions can react with one or more of O., OH., H. free radicals which are necessary for chain combustion reaction to stop the chain combustion reaction, and also can reduce the partial pressure of oxygen via physical effect to inhibit flames; the auxiliary fire extinguishing agent decomposes at the high temperature of an aerosol to release a large amount of gases to have synergistic interaction with an aerosol gas generated by combustion of the pyrotechnic agent to extinguish a fire jointly, thus further improving the fire extinguishing efficacy of the fire extinguishing agent and greatly shortening the effective fire extinguishing time.

The fire extinguishing composition of the application has the following advantages:

1. the metal carbonyl complexes used in the fire extinguishing composition of the application can decompose at high temperature to release a large amount of metal ions which can capture free radicals in combustion reaction, thus cutting off the reaction chain to extinguish a fire; the auxiliary fire extinguishing component can release a large amount of gases to play in fire extinguishing effect together with an aerosol gas generated by reaction of an aerosol generator; in the application, by selecting preferable contents of the components, an optimum proportion of the fire extinguishing composition is determined, thereby greatly improving the efficacy of the fire extinguishing composition; efficacies of the components in the fire extinguishing composition are fully utilized, which improves an effective utilization rate of the fire extinguishing composition;

2. the fire extinguishing composition of the application has endothermic decomposition reaction rapidly by using the heat generated by combustion of the aerosol generator, thus reducing the heat released by combustion of the pyrotechnic agent, greatly reducing the temperature of a nozzle of a fire extinguishing apparatus and sprayed substances, realizing higher safety performance and greatly shortening the fire extinguishing time;

3. the application adds components including a performance catalyst and an adhesive, thus further improving the fire extinguishing performance and processability of a fire extinguishing material so that the fire extinguishing material is easy to store in long term with stable performance;

4. the fire extinguishing composition of the application uses hydroxymethyl cellulose or hydroxyethyl cellulose as a surface coating agent, thus improving the surface finish, and increase the strength, wear resistance and shock resistance of the composition system, and preventing the fire extinguishing composition from pulverization, losing dregs and overflowing from a fire extinguishing apparatus during transportation process.

DETAILED DESCRIPTION OF THE INVENTION

The fire extinguishing composition of the application will be described more specifically through Examples below.

The fire extinguishing composition of the application may be shaped into spherical, flake, stripy, block, or honeycomb by using processes including pelleting, mould pressing and extrusion etc. and may be subjected to a surface coating treatment. Hydroxymethyl cellulose or hydroxyethyl cellulose is preferably added as a surface coating agent during the surface coating treatment. The surface coating agent can improve the surface finish, and increase the strength, wear resistance and shock resistance of the composition system, and preventing the fire extinguishing composition from pulverization, losing dregs and overflowing from a fire extinguishing apparatus during transportation process.

Through the following methods and experiments results, it can be undoubtedly concluded that the efficacy of the fire extinguishing composition of the application is obviously better tan existing fire extinguishing agents and the fire extinguishing time is also greatly shortened, specifically as follows:

EXAMPLE 1

50 g of a prepared composition sample comprising nickel tetracarbonyl, potassium bicarbonate, sodium chloride and dicyandiamide are added into a fire extinguishing apparatus containing 50 g of a K type hot aerosol generator. 93190 gasoline fire extinguishing test is performed on an oil disc having an area of 0.25 $m^2$. The test result is shown in Table 1 of test records.

EXAMPLE 2

50 g of a prepared composition sample comprising nickel tetracarbonyl, chromium hexacarbonyl, sodium bicarbonate, melamine, acetal adhesive and magnesium stearate are added into a fire extinguishing apparatus containing 50 g of a K type hot aerosol generator. 93190 gasoline fire extinguishing test is performed on an oil disc having an area of 0.25 $m^2$. The test result is shown in Table 1 of test records.

EXAMPLE 3

50 g of a prepared composition sample comprising iron pentacarbonyl, dicyandiamide, guanidine carbonate, acetal adhesive and magnesium stearate are added into a fire extinguishing apparatus containing 50 g of a K type hot aerosol generator. 93190 gasoline fire extinguishing test is performed on an oil disc having an area of 0.25 $m^2$, The test result is shown in Table 1 of test records.

EXAMPLE 4

50 g of a prepared composition sample comprising triruthenium dodecacarbonyl, sodium bicarbonate, sodium chloride, guanidine carbonate, hydroxypropyl methyl cellulose and talc are added into a fire extinguishing apparatus containing 50 g of a K type hot aerosol generator. 93190 gasoline fire extinguishing test is performed on an oil disc having an area of 0.25 $m^2$. The test result is shown in Table 1 of test records.

EXAMPLE 5

50 g of a prepared composition sample comprising molybdenum hexacarbonyl, potassium bicarbonate, sodium bicarbonate, acetal adhesive and magnesium stearate are added into a fire extinguishing apparatus containing 50 g of a K type hot aerosol generator. 93190 gasoline fire extinguishing test is performed on an oil disc having an area of 0.25 $m^2$, the test result is shown in Table 1 of test records.

EXAMPLE 6

50g of a prepared composition sample comprising nickel tetracarbonyl dimanganese decacarbonyl, and guanidine carbonate are added into a fire extinguishing apparatus containing 50 g of a K type hot aerosol generator. 93# gasoline fire extinguishing test is performed on an oil disc having an area of 0.25 $m^2$. The test result is shown in Table 1 of test records.

COMPARATIVE EXAMPLE 1

93# gasoline fire extinguishing test is performed on a fire extinguishing apparatus sample containing 100 g of a K type hot aerosol fire extinguishing agent of an oil disc having an area of 0.25 $m^2$. The test result is shown in Table 1 of test records.

COMPARATIVE EXAMPLE 2

93# gasoline fire extinguishing test is performed on a fire extinguishing apparatus sample containing 100 g of an S type hot aerosol fire extinguishing agent of an oil disc having an area of 0.25 $m^2$. The test result is shown in Table 1 of test records.

After being prepared and shaped, 50 g of a fire extinguishing composition prepared by fire extinguishing materials, adhesives and additives in the following table, is respectively added into fire extinguishing apparatuses containing 50 g of a K type aerosol generator, and 8B fire extinguishing tests is performed respectively. Specific models are as shown by 6.3.2.1 in GA86-2009. Three shots are launched in each group. The fire extinguishing effect and fire extinguishing time are recorded and the test results are as shown in Table 1.

Samples of fire extinguishing apparatuses respectively containing 100 g of an S type aerosol fire extinguishing agent or a K type aerosol fire extinguishing agent are compared, and fire extinguishing tests are performed in the same conditions. The fire extinguishing effect and spraying time are recorded and results are as shown in Table 1.

TABLE 1

Comparison in components of compositions and test results

| Composition component | | Component content (mass percent) of Examples | | | | | | Comparison example | |
|---|---|---|---|---|---|---|---|---|---|
| | | 1 | 2 | 3 | 4 | 5 | 6 | 1 | 2 |
| Fire extinguishing material | Commercially available S type fire extinguishing agent | | | | | | | | ● |
| | Commercially available K type fire extinguishing agent | | | | | | | ● | |
| | nickel tetracarbonyl | 35 | 30 | | | | 45 | | |
| | iron pentacarbonyl | | | 5 | | | | | |
| | triruthenium dodecacarbonyl | | | | 55 | | | | |
| | chromium hexacarbonyl | | 40 | | | | | | |
| | molybdenum hexacarbonyl | | | | | 60 | | | |
| | dimanganese decacarbonyl | | | | | | 45 | | |
| | Potassium bicarbonate | 20 | | | | 10 | | | |
| | Sodium bicarbonate | | 10 | | 10 | 10 | | | |
| | Sodium chloride | 20 | | | 5 | | | | |
| | Dicyandiamide | 25 | | 45 | | | | | |
| | Melamine | | 15 | | | | | | |
| | Guanidine carbonate | | | 50 | 25 | | 10 | | |
| Adhesive | Acetal adhesive | | 3 | | | 8 | | | |
| | Hydroxypropyl methyl cellulose | | | | 3 | 2 | | | |
| Additive | Magnesium stearate | | 2 | | | 5 | | | |
| | Talc | | | | 2 | | | | |
| | Graphite powder | | | | | 5 | | | |

TABLE 1-continued

| Comparison in components of compositions and test results | | | | | | | | |
|---|---|---|---|---|---|---|---|---|
| | Component content (mass percent) of Examples | | | | | | Comparison example | |
| Composition component | 1 | 2 | 3 | 4 | 5 | 6 | 1 | 2 |
| Comparison in test results | | | | | | | | |
| Fire extinguishing situation | Three shots completely extinguished | Three shots completely extinguished | Two shots completely extinguished | Three shots completely extinguished | Three shots completely extinguished | Three shots completely extinguished | No shot extinguished | No shot extinguished |
| Spraying time/s | 11.55 | 11.48 | 12.11 | 10.87 | 11.26 | 11.06 | 16.22 | 32.10 |

EXAMPLE 7

50 g of a prepared composition sample comprising triiron dodecarbonyl, dicobalt octacarbonyl, manganous dihydrogen phosphate, basic cupric carbonate and cobaltous chloride are added into a fire extinguishing apparatus containing 50 g of a K type hot aerosol generator. 93# gasoline fire extinguishing test is performed on an of an oil disc having an area of 0.25 $m^2$. the test result is shown in Table 2 of test records.

EXAMPLE 8

50 g of a prepared composition sample comprising nickel tetracarbonyl, manganous dihydrogen phosphate, cobaltous carbonate and guanidine carbonate are added into a fire extinguishing apparatus containing 50 g of a K type hot aerosol generator. 93# gasoline fire extinguishing test is performed on an of an oil disc having an area of 0.25 $m^2$. The test result is shown in Table 2 of test records.

EXAMPLE 9

50 g of a prepared composition sample comprising manganese hexacarbonyl, molybdenum hexacarbonyl, ferric oxide, cobaltous chloride and guanidine carbonate are added into a fire extinguishing apparatus containing 50 g of a K type hot aerosol generator. 93# gasoline fire extinguishing test is performed on an of an oil disc having an area of 0.25 $m^2$. The test result is shown in Table 2 of test records.

EXAMPLE 10

50 g of a prepared composition sample comprising nickel tetracarbonyl, dimanganese decacarbonyl, cobaltous carbonate, ferric oxide, acetal adhesive and talc are added into a fire extinguishing apparatus containing 50 g of a K type hot aerosol generator. 93# gasoline fire extinguishing test is performed on an of an oil disc having an area of 0.25 $m^2$. The test result is shown in Table 2 of test records.

EXAMPLE 11

50 g of a prepared composition sample comprising triiron dodecarbonyl, chromium hexacarbonyl, dicobalt octacarbonyl, basic cupric carbonate, cobaltous chloride, hydroxypropyl methyl cellulose and magnesium stearate are added into a fire extinguishing apparatus containing 50 g of a K type hot aerosol generator. 93190 gasoline fire extinguishing test is performed on an of an oil disc having an area of 0.25 $cm^2$. The test result is shown in Table 2 of test records.

EXAMPLE 12

50 g of a prepared composition sample comprising nickel tetracarbonyl, manganese hexacarbonyl, dicobalt octacarbonyl, guanidine carbonate, hydroxypropyl methyl cellulose and graphite powder are added into a fire extinguishing apparatus containing 50 g of a K type hot aerosol generator. 93# gasoline fire extinguishing test is performed on an of an oil disc having an area of 0.25 $cm^2$. The test result is shown in Table 2 of test records.

After being prepared and shaped 50 g of a fire extinguishing composition prepared by fire extinguishing materials, adhesives and additives in the following table, is respectively added into fire extinguishing apparatuses containing 50 g of a K type aerosol generator, and 8B fire extinguishing tests is performed respectively. Specific models are as shown by 6.3.2.1 in GA86-2009. Three shots are launched in each group. The fire extinguishing effect and fire extinguishing time are recorded and the test results are as shown in Table 2.

Comparative examples are the same as the comparative examples above. Samples of fire extinguishing apparatuses respectively containing 100 g of an S type aerosol fire extinguishing agent or a K type aerosol fire extinguishing agent subjected to fire extinguishing tests in the same conditions. The fire extinguishing effect and spraying time are recorded and results are as shown in Table 2.

TABLE 2

| Comparison in components of compositions and test results | | | | | | | | | |
|---|---|---|---|---|---|---|---|---|---|
| | | Component content (mass percent) of Examples | | | | | | Comparison example | |
| Composition component | | 7 | 8 | 9 | 10 | 11 | 12 | 1 | 2 |
| Fire extinguishing material | Commercially available S type fire extinguishing agent | | | | | | | | ● |

TABLE 2-continued

| Comparison in components of compositions and test results | | | | | | | | | |
|---|---|---|---|---|---|---|---|---|---|
| | | Component content (mass percent) of Examples | | | | | | Comparison example | |
| Composition component | | 7 | 8 | 9 | 10 | 11 | 12 | 1 | 2 |
| | Commercially available K type fire extinguishing agent | | | | | | | ● | |
| | nickel tetracarbonyl | | 25 | | 20 | | 25 | | |
| | triiron dodecarbonyl | | | | | 10 | | | |
| | manganese hexacarbonyl | | | 15 | | | | | |
| | chromium hexacarbonyl | | | | | 45 | | | |
| | molybdenum hexacarbonyl | | | 30 | | | | | |
| | dimanganese decacarbonyl | | | | 45 | | | | |
| | dicobalt octacarbonyl | 30 | | | | 30 | 15 | | |
| | Manganous dihydrogen phosphate | 5 | 30 | | | | | | |
| | Cobaltous carbonate | | 35 | | 20 | | 35 | | |
| | Basic cupric carbonate | 20 | | | | | | | |
| | Ferric oxide | | | 15 | 10 | | | | |
| | Cobaltous chloride | 30 | | 10 | | 10 | | | |
| | Guanidine carbonate | | 10 | 30 | | | 20 | | |
| Adhesive | Acetal adhesive | | | | 3 | | | | |
| | Hydroxypropyl methyl cellulose | 5 | | | | 3 | 3 | | |
| Additive | Magnesium stearate | 6 | | | | 2 | | | |
| | Talc | 4 | | | 2 | | | | |
| | Graphite powder | | | | | 2 | | | |
| Comparison in test results | | | | | | | | | |
| Fire extinguishing situation | | Two shots completely extinguished | Three shots completely extinguished | Three shots completely extinguished | Three shots completely extinguished | Three shots completely extinguished | Three shots completely extinguished | No shot extinguished | No shot extinguished |
| Spraying time/s | | 12.05 | 11.95 | 10.77 | 12.25 | 10.77 | 11.75 | 13.77 | 34.55 |

It can be concluded from Table 1 and Table 2 that: two shots or three shots can be extinguished by the fire extinguishing composition of the application and no shot is extinguished by existing products. In addition, the longest spraying time of the application is 12.25s while the spraying time of an existing product may be as long as 34.55s. A long period of spraying time means the fire extinguishing efficacy would be affected. Therefore, the efficacy of the fire extinguishing composition of the application is obviously better than that of the existing products.

What we claim is:

1. A fire extinguishing apparatus, comprising a pyrotechnic agent and a fire extinguishing composition comprising one or more metal carbonyl complex wherein, during operation, the pyrotechnic agent produces heat that enables the fire extinguishing composition to decompose or react, and thereby produces fire extinguishing substances that ejects out from the fire extinguishing apparatus, fire extinguishing substances wherein the pyrotechnic agent is a hot aerosol generator, and wherein the metal carbonyl complex is nickel tetracarbonyl $Ni(CO)_4$, ruthenium pentacarbonyl $Ru(CO)_5$, pentacarbonyl osmium $Os(CO)_5$, triruthenium dodecacarbonyl $Ru_3(CO)_{12}$, dodecacarbonyltriosmium $Os_3(CO)_{12}$, vanadium hexacarbonyl $V(CO)_6$, molybdenum hexacarbonyl $Mo(CO)_6$, tungsten hexacarbonyl $W(CO)_6$, titanium hexacarbonyl $Ti(CO)_6$, manganese hexacarbonyl $Mn(CO)_6$, dimanganese decacarbonyl $Mn_2(CO)_{10}$, ditechnetium decacarbonyl $Tc_2(CO)_{10}$, dirhenium decacarbonyl $Re_2(CO)_{10}$, or dicobalt octacarbonyl $Co_2(CO)_8$.

2. The fire extinguishing apparatus according to claim 1, wherein the metal carbonyl complex is nickel tetracarbonyl $Ni(CO)_4$, molybdenum hexacarbonyl $Mo(CO)_6$, tungsten hexacarbonyl $W(CO)_6$, manganese hexacarbonyl $Mn(CO)_6$, dimanganese decacarbonyl $Mn_2(CO)_{10}$, or dicobalt octacarbonyl $Co_2(CO)_8$.

3. The fire extinguishing apparatus according to claim 1, wherein the fire extinguishing composition further comprises an auxiliary fire extinguishing agent.

4. The fire extinguishing apparatus according to claim 3, wherein the auxiliary fire extinguishing agent is one or more of phosphate, carbonate, basic carbonate, metal halide, metal oxide, melamine, ammonium sulfate, dicyandiamide, guanidine carbonate, nitroguanidine, or guanidine phosphate.

5. The fire extinguishing apparatus according to claim 4, wherein the phosphate is one or more of calcium dihydrogen phosphate, sodium dihydrogen phosphate, sodium dihydrogenphosphate dihydrate, potassium dihydrogen phosphate, aluminum dihydrogen phosphate, ammonium dihydrogen phosphate, zinc dihydrogen phosphate, manganous dihydrogen phosphate, magnesium dihydrogen phosphate, disodium hydrogen phosphate, diammonium hydrogen phosphate, calcium hydrogen phosphate, magnesium hydrogen phosphate, ammonium phosphate, or magnesium ammonium phosphate.

6. The fire extinguishing apparatus according to claim 4, wherein the carbonate is one or more of cobaltous carbonate, zinc carbonate, manganous carbonate, ferrous carbonate, strontium carbonate, sodium potassium carbonate hexahydrate, lithium carbonate, nickel carbonate, or calcium carbonate.

7. The fire extinguishing apparatus according to claim 4, wherein the basic carbonate is one or more of basic cupric carbonate, basic magnesium carbonate, basic cobaltous carbonate, basic zinc carbonate, basic nickel carbonate, or basic calcium carbonate.

8. The fire extinguishing apparatus according to claim 4, wherein the metal halide is one or more of potassium fluoride, potassium chloride, potassium bromide, potassium iodide, ammonium fluoride, ammonium chloride, ammonium bromide, sodium fluoride, sodium chloride, sodium bromide, sodium iodide, cobaltous chloride, ferric chloride, or ferrous chloride.

9. The fire extinguishing apparatus according to claim 4, wherein the metal oxide is one or more of zinc oxide, coppic oxide, aluminium oxide, ferric oxide, ferriferrous oxide, ferrous oxide, or antimony trioxide.

10. The fire extinguishing apparatus according to claim 1, wherein fire extinguishing composition further comprises an adhesive and the adhesive is one or more of water glass, shellac, starch, dextrin, rubber, epoxy resin, acetal adhesive, hydroxypropyl methyl cellulose or phenolic resin.

11. The fire extinguishing apparatus according to claim 10, wherein the fire extinguishing composition further comprises an additive and the additive is stearate, talc, graphite or a mixture thereof.

12. The fire extinguishing apparatus according to claim 1, wherein the hot aerosol generator is a K type hot aerosol generator or an S type hot aerosol generator.

13. The fire extinguishing apparatus according to claim 12, wherein the amount of the hot aerosol generator equals the amount of the fire extinguishing composition.

14. The fire extinguishing apparatus according to claim 3, wherein the auxiliary fire extinguishing agent is larger than 10 mass % and less than or equal to 95 mass % of the total mass of the fire extinguishing composition.

15. The fire extinguishing apparatus according to claim 10, wherein the adhesive is larger than 0 mass % and less than or equal to 15 mass% of the total mass of the fire extinguishing composition.

* * * * *